US012559695B2

(12) United States Patent
Kato

(10) Patent No.: US 12,559,695 B2
(45) Date of Patent: Feb. 24, 2026

(54) SHOCK ABSORBER LUBRICANT COMPOSITION, SHOCK ABSORBER, AND METHOD FOR ADJUSTING FRICTION CHARACTERISTICS OF SHOCK ABSORBER LUBRICANT

(71) Applicant: KYB Corporation, Tokyo (JP)

(72) Inventor: Shinji Kato, Tokyo (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 18/703,029

(22) PCT Filed: Oct. 13, 2022

(86) PCT No.: PCT/JP2022/038239
§ 371 (c)(1),
(2) Date: Apr. 19, 2024

(87) PCT Pub. No.: WO2023/068163
PCT Pub. Date: Apr. 27, 2023

(65) Prior Publication Data

US 2024/0417646 A1 Dec. 19, 2024

(30) Foreign Application Priority Data

Oct. 22, 2021 (JP) ..... 2021-172939

(51) Int. Cl.
*C10M 169/04* (2006.01)
*C10M 105/34* (2006.01)
(Continued)

(52) U.S. Cl.
CPC ..... *C10M 169/04* (2013.01); *C10M 105/34* (2013.01); *C10M 129/74* (2013.01);
(Continued)

(58) Field of Classification Search
CPC ..... C10M 169/04; C10M 105/34; C10M 129/74; C10M 137/10; C10M 141/10;
(Continued)

(56) References Cited

U.S. PATENT DOCUMENTS

2005/0119137 A1* 6/2005 Choo ..... C10M 105/34 554/174
2007/0259792 A1 11/2007 Null
(Continued)

FOREIGN PATENT DOCUMENTS

JP 2006-104231 A 4/2006
JP 2009-530460 A 8/2009
(Continued)

OTHER PUBLICATIONS

Nakanishi, H., "Technical Trends and Tribology of Shock Absorber", Tribologist, 2009, vol. 54, No. 9, p. 598-603, with partial English translation, cited in Specification. (8 pages).
(Continued)

*Primary Examiner* — Prem C Singh
*Assistant Examiner* — Francis C Campanell
(74) *Attorney, Agent, or Firm* — WHDA, LLP

(57) ABSTRACT

Provided are a shock absorber-lubricating oil composition, a lubricating oil additive, and a method for adjusting the friction characteristics of the shock absorber-lubricating oil composition, capable of making both operation stability and ride comfort compatible with each other. A shock absorber-lubricating oil composition contains a base oil and a friction modifier. The friction modifier contains a pentaerythritol ester. The base oil contains an ester oil as a main component.

15 Claims, 4 Drawing Sheets

(51) Int. Cl.

| | |
|---|---|
| ***C10M 129/74*** | (2006.01) |
| ***C10M 137/10*** | (2006.01) |
| ***C10M 141/10*** | (2006.01) |
| *C10N 30/02* | (2006.01) |
| *C10N 40/08* | (2006.01) |

(52) U.S. Cl.
CPC ..... *C10M 137/10* (2013.01); *C10M 141/10* (2013.01); *C10M 2207/2815* (2013.01); *C10M 2207/283* (2013.01); *C10M 2223/045* (2013.01); *C10N 2030/02* (2013.01); *C10N 2040/08* (2013.01)

(58) Field of Classification Search
CPC .... C10M 2207/2815; C10M 2207/283; C10M 2223/045; C10M 2203/1025; C10M 2203/1065; C10M 2205/0285; C10N 2030/02; C10N 2040/08; C10N 2030/06
USPC ..... 508/378
See application file for complete search history.

(56) References Cited

U.S. PATENT DOCUMENTS

| | | | | |
|---|---|---|---|---|
| 2016/0194576 | A1* | 7/2016 | Sakanoue | C10M 137/10 508/370 |
| 2020/0399197 | A1* | 12/2020 | Patil | C09K 5/20 |
| 2022/0204882 | A1 | 6/2022 | Kato | |

FOREIGN PATENT DOCUMENTS

| | | | |
|---|---|---|---|
| JP | 2021-102671 | A | 7/2021 |
| WO | 2021/070433 | A1 | 4/2021 |

OTHER PUBLICATIONS

English translation of International Search Report dated Dec. 27, 2022, issued in counterpart International Application No. PCT/JP2022/038239. (2 pages).

* cited by examiner

[FIG. 1]
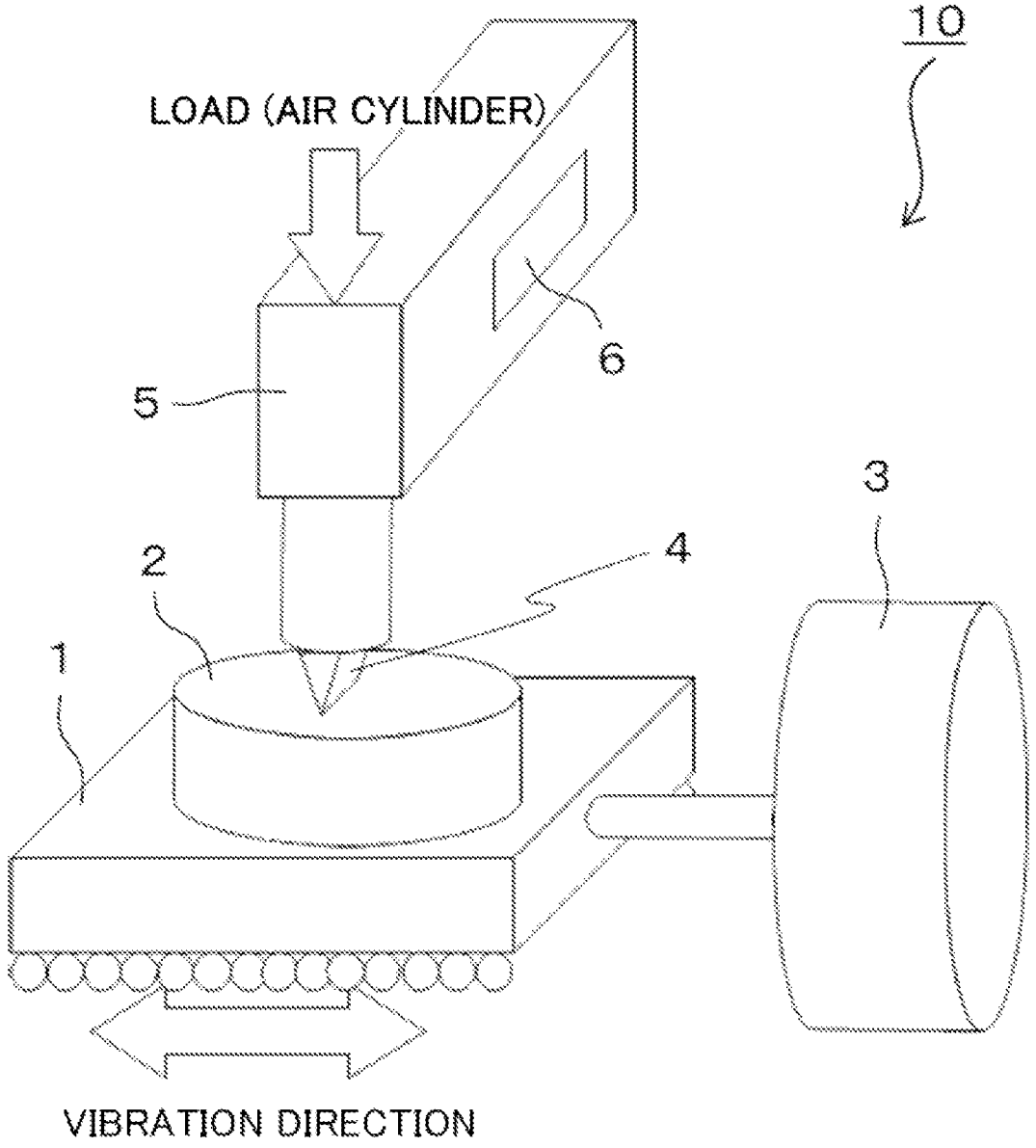

[FIG. 2]
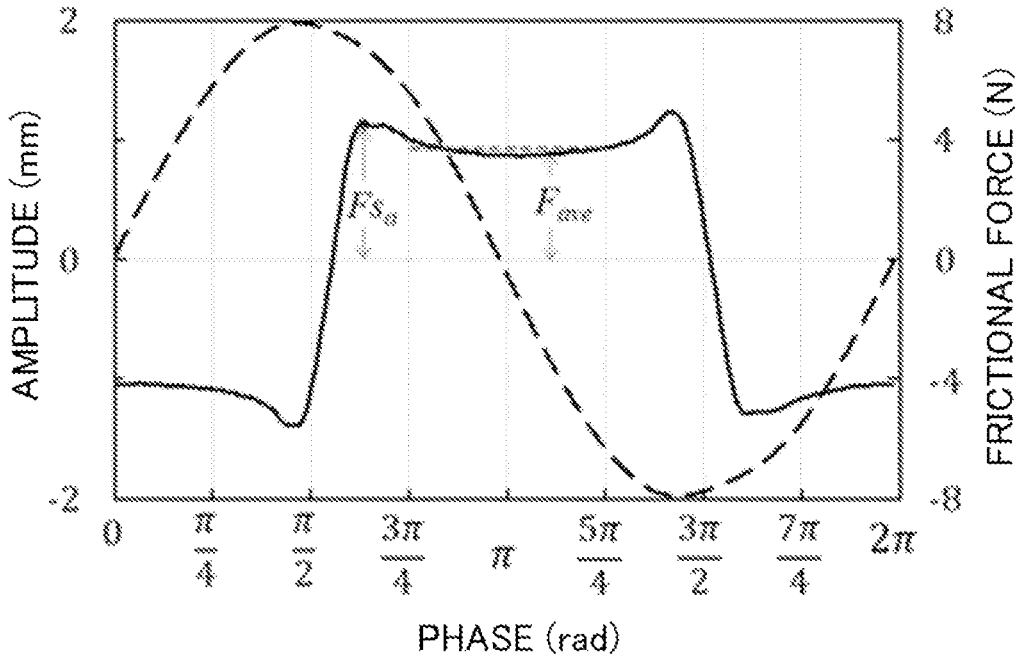
[FIG. 3]
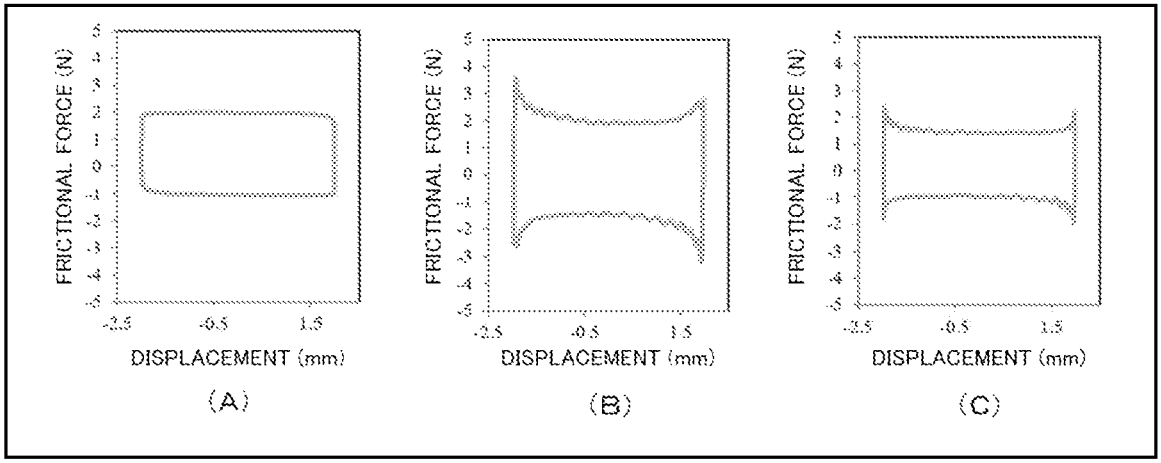

[FIG. 4]
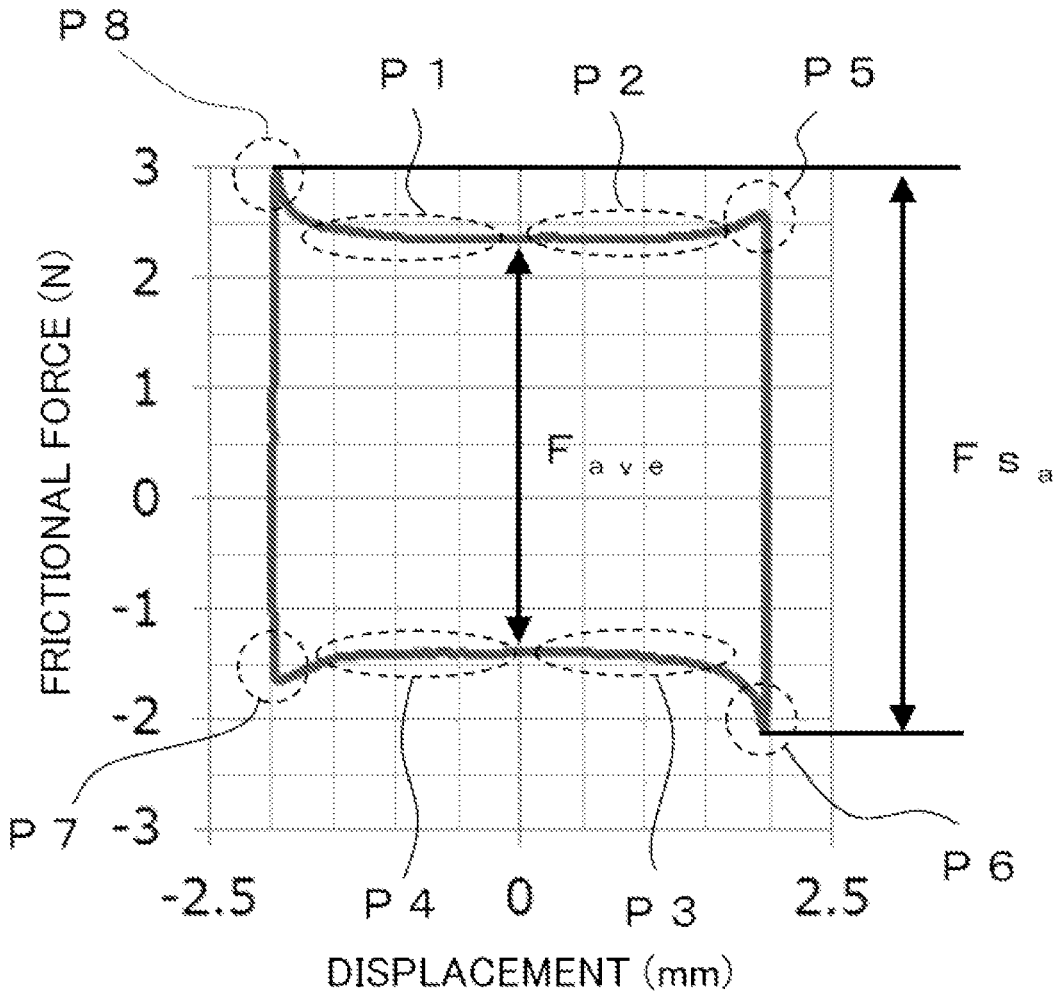

[FIG. 5]
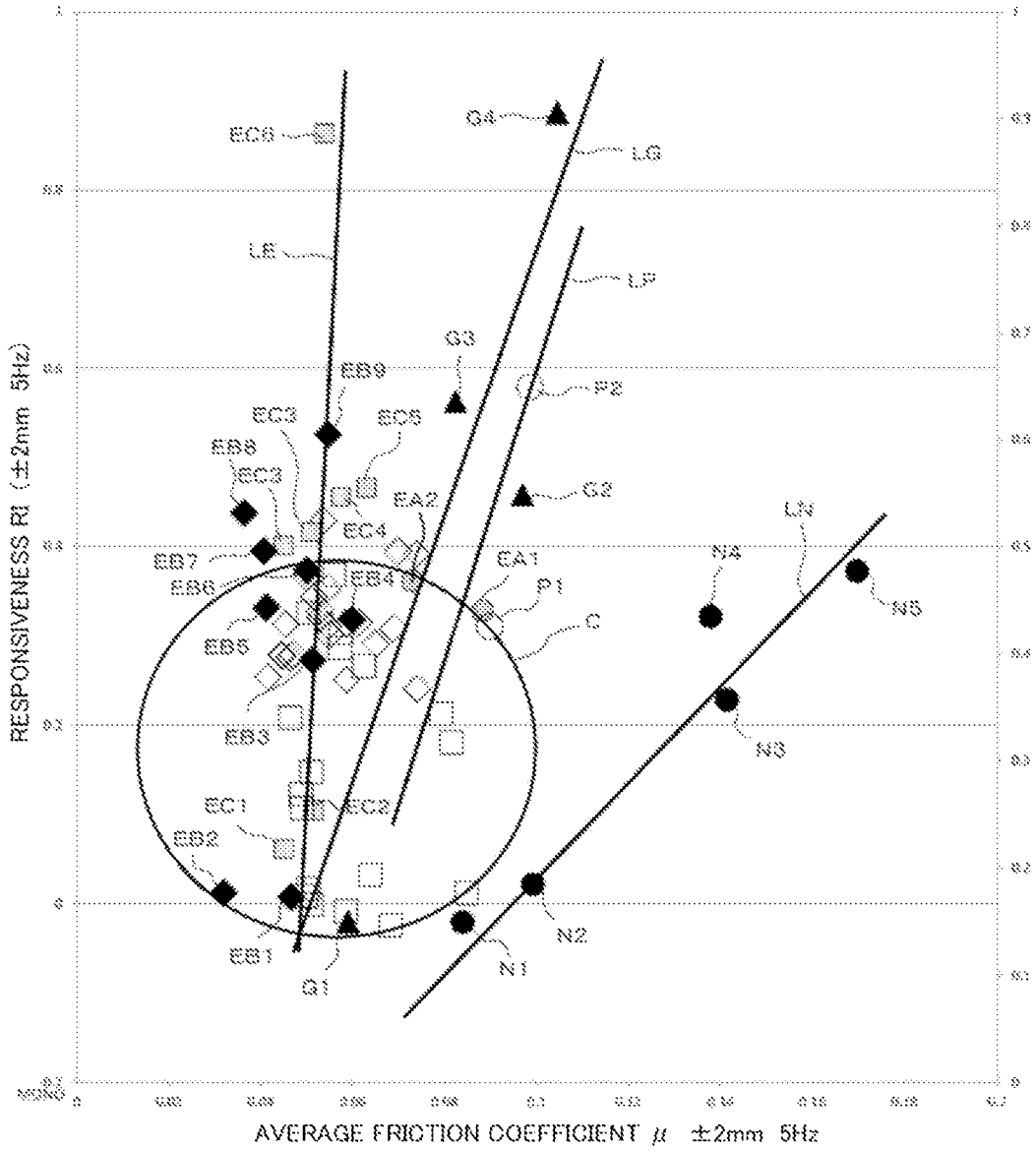

SHOCK ABSORBER LUBRICANT COMPOSITION, SHOCK ABSORBER, AND METHOD FOR ADJUSTING FRICTION CHARACTERISTICS OF SHOCK ABSORBER LUBRICANT

TECHNICAL FIELD

The present invention relates to a shock absorber lubricating oil composition, a shock absorber, and a method for adjusting the friction characteristics of a shock absorber lubricating oil.

BACKGROUND ART

In the related art, the vibration control force of a shock absorber is known to be a combined force of a hydraulic damping force generated in a valve and a frictional force generated at a sliding portion between a piston rod and an oil seal or between a piston and a cylinder. In addition, it is known that, in a case where the vibration control force of the shock absorber is large, the operation stability is increased but the ride comfort deteriorates, and conversely, in a case where the vibration control force of the shock absorber is small, the operation stability deteriorates but the ride comfort is good. For that reason, in recent years, the research for adjusting a friction modifier added to a shock absorber lubricating oil to reduce the frictional force of the shock absorber lubricating oil and to reduce the vibration control force of the shock absorber has been performed by paying attention to the ride comfort (for example, Non-Patent Document 1).

CITATION LIST

Non-Patent Documents

[Non-Patent Document 1] Technique Trend and Tribology of Shock Absorber (Hiroshi Nakanishi, Tribologist, 2009 (Vol. 54), No. 9, pp. 598)

SUMMARY

Technical Problem

The shock absorber exerts a vibration control force by reciprocating motion. However, it takes a certain amount of time for the hydraulic damping force to rise, while the responsiveness of the frictional force is high. Therefore, when a stationary state transits to a slip state or at a minute amplitude, the frictional force is an important factor in the vibration control force of the shock absorber. However, when the frictional force of the shock absorber-lubricating oil is reduced with a focus on the ride comfort as in the related art, there is a problem that the vibration control force also becomes small, and the operation stability deteriorates. In particular, in recent years, there are many well-maintained roads, and vibrations with a slightly smaller amplitude than the normal amplitude are often generated. Therefore, there has been a demand for shock absorber-lubricating oil compositions capable of making both the operation stability and the ride comfort compatible with each other in a case where the stationary state transits to the slip state or at a minute amplitude.

The present invention provides a shock absorber-lubricating oil composition, a shock absorber, and a method for adjusting the friction characteristics of a shock absorber-lubricating oil, capable of making both operation stability and ride comfort compatible with each other.

Solution to Problem

The gist of the present invention is shock absorber-lubricating oil compositions in the following (1) to (8).

(1) A shock absorber-lubricating oil composition containing a base oil, and a friction modifier, in which the friction modifier contains a pentaerythritol ester, and the base oil contains an ester oil as a main component.

(2) The shock absorber-lubricating oil composition set forth in the above (1), in which the ester oil is a monoester oil.

(3) The shock absorber-lubricating oil composition set forth in the above (1) or (2), in which the base oil contains the ester oil in 50% by weight or more of the whole base oil, or a proportion of the ester oil in the base oil is largest.

(4) The shock absorber-lubricating oil composition set forth in any one of the above (1) to (3), in which the base oil contains 90% by weight or more of the ester oil in the base oil.

(5) The shock absorber-lubricating oil composition set forth in any one of the above (1) to (4), in which the pentaerythritol ester contains a pentaerythritol tetraester as a main component.

(6) The shock absorber-lubricating oil composition set forth in any one of the above (1) to (5), in which the pentaerythritol ester is a pentaerythritol ester having a medium-chain fatty acid.

(7) The shock absorber-lubricating oil composition set forth in any one of the above (1) to (6), in which the base oil has a viscosity index of 60 or less.

(8) The shock absorber-lubricating oil composition set forth in any one of the above (1) to (7), in which the friction modifier further contains zinc dithiophosphate.

In addition, the gist of the present invention is a shock absorber in the following (9).

(9) A shock absorber containing the shock absorber-lubricating oil composition set forth in any one of the above (1) to (8).

In addition, the gist of the present invention is a method for adjusting friction characteristics of the shock absorber-lubricating oil composition in the following (10).

(10) A method for adjusting friction characteristics of a shock absorber-lubricating oil composition, the method including adding a friction modifier containing a pentaerythritol ester to a base oil containing an ester oil as a main component.

Advantageous Effects of Invention

According to the present invention, it is possible to provide the shock absorber-lubricating oil composition, the shock absorber, and the method for adjusting the friction characteristics of the shock absorber-lubricating oil, capable of making both operation stability and ride comfort compatible with each other.

BRIEF DESCRIPTION OF DRAWINGS

FIG. 1 is a view for describing a friction test device used in a friction test of a shock absorber-lubricating oil according to the present invention.

FIG. 2 is a view for describing a method for measuring the friction characteristics of the shock absorber-lubricating oil according to the present invention.

(A) and (B) of FIG. 3 are views illustrating the friction characteristics of a shock absorber-lubricating oil according to a comparative example in circulating figures, and (C) of FIG. 3 is a view illustrating the friction characteristics of a shock absorber-lubricating oil according to the present example in a circulating figure.

FIG. 4 is a view for describing a circulating figure.

FIG. 5 is a view illustrating measurement results of the friction characteristics of various shock absorber-lubricating oils.

DESCRIPTION OF EMBODIMENTS

Hereinafter, a shock absorber-lubricating oil composition, a shock absorber, and a method for adjusting the friction characteristics of a shock absorber-lubricating oil according to the present invention will be described with reference to the drawings. In the following, the present invention will be described by exemplifying the shock absorber-lubricating oil.

The lubricating oil according to the present embodiment has (A) a base oil and (B) a friction modifier, and (B) the friction modifier contains (B1) zinc dithiophosphate (hereinafter, also referred to as ZnDTP) and (B2) pentaerythritol.

(A) Base Oil

The shock absorber-lubricating oil according to the present invention is characterized in that the base oil contains an ester oil as a main component. Specifically, the base oil is characterized by containing the ester oil in 50% by weight or more of the whole base oil or containing the ester oil in the largest proportion. The shock absorber-lubricating oil according to the present invention may have the ester oil as a main component, as the base oil, and may be configured to have a base oil in which the ester oil and a mineral oil are mixed. In addition, the base oil is preferably configured to contain the ester oil in 90% by weight or more of the whole base oil, and more preferably contains only the ester oil. In the present embodiment, the base oil is composed of only a commercially available ester oil.

As the ester oil, it is possible to use a monoester, a diester, a polyol ester, a phosphoric acid ester, or the like, and the monoester is particularly preferable. In addition, examples of the monoester include fatty acid monoesters that are combinations of fatty acids with 6 to 22 carbon atoms such as oleic acid, adipic acid, pelargonic acid, palm oil fatty acid, palmitic acid, beef tallow fatty acid, and pelargonic acid, and alcohols such as 2-ethylhexanol, isooctyl alcohol, and isodecyl alcohol, and neopentyl glycol. In the shock absorber-lubricating oil according to the present invention, as the ester oil, it is possible to mix and use a monoester and another ester oil, but it is preferable that the monoester is contained in 50% by weight or more of the whole ester oil or that the monoester is contained in the highest proportion.

In addition, the base oil preferably has a kinematic viscosity of 10 $mm^2/s$ or less at 40°° C. or a kinematic viscosity of 2 $mm^2/s$ or less at 100° C. By lowering the viscosity of the base oil, it is possible to add a thickener and accordingly, it is possible to further adjust the friction characteristics of the shock absorber-lubricating oil. For example, a monoester of 2-ethylhexanol and palm oil fatty acid has a low kinematic viscosity of 6 $mm^2/s$ at 40° C. and a kinematic viscosity of 1.8 $mm^2/s$ at 100°° C. and is capable of being added with a thickener to adjust the friction characteristics of the shock absorber-lubricating oil.

(B) Friction Modifier

The shock absorber-lubricating oil according to the present embodiment contains the friction modifier. The friction modifier is not particularly limited but may contain various friction modifiers such as phosphorus-based, amine-based, and ester-based friction modifiers. The friction coefficient of the shock absorber-lubricating oil is capable of being adjusted by adjusting the amount of the friction modifier added. In addition, the shock absorber-lubricating oil according to the present embodiment contains (B1) zinc dithiophosphate and (B2) pentaerythritol ester as the friction modifier.

(B1) Zinc Dithiophosphate (ZnDTP)

ZnDTP is generally a compound represented by the following Chemical Formula 1 and has the function of assisting in adjusting the friction coefficient by the friction modifier.

[Chemical 1]

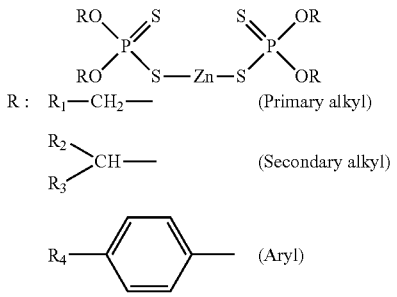

[In the above Chemical Formula 1, R represents an individual hydrocarbon group, and examples thereof include a linear primary alkyl group, a branched secondary alkyl group, and an aryl group.]

In this way, a plurality of types (structures) of ZnDTP is known, such as those having the primary alkyl group, the secondary alkyl group, or the aryl group, but the shock absorber-lubricating oil according to the present embodiment contains two types of ZnDTP to be described below.

That is, the shock absorber-lubricating oil according to the present embodiment contains ZnDTP represented by the following Chemical Formula 2 as a first ZnDTP.

[Chemical 2]

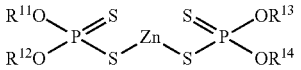

(1)

[In Formula 1, $R^{11}$ to $R^{14}$ are alkyl groups, and the alkyl groups have the primary alkyl group and the secondary alkyl group. That is, one or more and three or less of $R^{11}$ to $R^{14}$ are the primary alkyl group, and the rest of $R^{11}$ to $R^{14}$ are the secondary alkyl group.]

In the first ZnDTP, the primary alkyl group is not particularly limited, and examples thereof include a methyl group, an ethyl group, an n-propyl group, an n-butyl group, an n-pentyl group, an n-hexyl group, an n-heptyl group, an n-octyl group, an n-nonyl group, an n-decyl group, an isoamyl group, an isobutyl group, a 2-methylbutyl group, a 2-ethylhexyl group, a 2,3-dimethylbutyl group, a 2-methylpentyl group, and the like. However, an alkyl group having 4 to 12 carbon atoms (for example, an isobutyl group (4 carbon atoms) or the 2-ethylhexyl group (8 carbon atoms)) is preferable.

In addition, in the first ZnDTP, the secondary alkyl group is not particularly limited, and examples thereof include an isopropyl group, a sec-butyl group, a 1-ethylpropyl group, a 2-ethylhexyl group, a 4-methyl-2-pentyl group, and the like. However, an alkyl group having 3 to 6 carbon atoms (for example, an isopropyl group (3 carbon atoms)) is preferable.

In addition, in the first ZnDTP, the ratio of the primary alkyl group and the secondary alkyl group is not particularly limited, but it is preferable that the ratio of the primary alkyl group is higher than that of the secondary alkyl group.

The content of the first ZnDTP is not particularly limited but the first ZnDTP is contained in preferably 0.1% by mass or more and more preferably 0.4% by mass or more in the shock absorber-lubricating oil. In addition, the content of the first ZnDTP is preferably 4.0% by mass or less and more preferably 2.0% by mass or less in the shock absorber-lubricating oil.

In this way, the shock absorber-lubricating oil according to the present invention includes the first ZnDTP having both the primary alkyl group and the secondary alkyl group. Accordingly, in a case where the friction modifier is added, it is possible to easily adjust a friction coefficient suitable for ride comfort and control stability. In addition to this, compared to a shock absorber-lubricating oil containing ZnDTP having only the primary alkyl group and/or ZnDTP having only the secondary alkyl group, it is possible to suppress the variation in the friction coefficient and to further improve the ride comfort.

Moreover, the shock absorber-lubricating oil according to the present embodiment has a second ZnDTP having a structure different from that of the first ZnDTP as the friction modifier. The second ZnDTP is represented by the following Chemical Formula 3.

[Chemical 3]

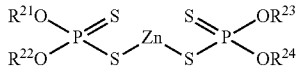

(2)

[In Formula 2, $R^{21}$ to $R^{24}$ are the secondary alkyl group. That is, the second ZnDTP does not have the primary alkyl group and has only the secondary alkyl group.]

The number of carbon atoms of the secondary alkyl group of the second ZnDTP is not particularly limited, and examples of the secondary alkyl group include an isopropyl group, a sec-butyl group, a 1-ethylpropyl group, a 2-ethylhexyl group, a 4-methyl-2-pentyl group, and the like. However, an alkyl group having 3 to 8 carbon atoms (for example, the isopropyl group (3 carbon atoms), 2-ethylhexyl group (8 carbon atoms), the isobutyl group (4 carbon atoms), or the like) is preferable as the secondary alkyl group.

In addition, the content of the second ZnDTP is not particularly limited but is preferably smaller than the content of the first ZnDTP and is preferably 20% by weight or less with respect to the amount of ZnDTP added (the total amount of the first ZnDTP and the second ZnDTP).

What kind of alkyl group the ZnDTP contains is capable of being measured by a known measuring method. For example, it is also possible to determine the structure of ZnDTP by using $C^{13}$-NMR. It is also possible to determine the structure of ZnDTP by analyzing whether the alkyl group is the primary alkyl group or the secondary alkyl group from the characteristics of the absorption band of P—O—C and the absorption bands of P═S and P—S by using the fingerprint region of FT-IR.

(B1) By containing the second ZnDTP having only the secondary alkyl group as the dithiophosphate, it is possible to further improve the ride comfort compared to a case where only the first ZnDTP is contained. Specifically, it is possible to further reduce a minute vibration during driving compared to a case where only the first ZnDTP is contained. In addition, by setting the second ZnDTP to ZnDTP having a secondary alkyl group having 3 to 8 carbon atoms, it is possible to reduce a difference in friction coefficient between the minute amplitude (low speed) and the normal amplitude (high speed), and it is possible to improve the ride comfort.

(B2) Pentaerythritol Ester

The pentaerythritol ester is a tetravalent sugar alcohol and is a compound in which a hydroxide, which is a terminal substituent of pentaerythritol, is ester-bonded with a fatty acid residue. As the pentaerythritol ester, there are a pentaerythritol tetraester, a pentaerythritol monoester, a pentaerythritol diester, and a pentaerythritol triester. The pentaerythritol tetraester has all four terminal substituents ester-bonded with the fatty acid residue. The pentaerythritol monoester, the pentaerythritol diester, and the pentaerythritol triester are a partial ester in which any one of the terminal substituents is/are ester-bonded with the fatty acid residue(s). In the following, descriptions will be made with the pentaerythritol tetraester abbreviated as PE4E, the pentaerythritol triester abbreviated as PE3E, the pentaerythritol diester abbreviated as PE2E, and the pentaerythritol monoester abbreviated as PE1E.

In the pentaerythritol ester according to the present invention, the fatty acid residue is not particularly limited and may be, for example, a C6 to C22 fatty acid residue such as a stearic acid residue or an oleic acid residue. In addition, as the fatty acid residue, caprylic acid, capric acid, oleic acid, stearic acid, myristic acid, palmitic acid, linoleic acid, adipic acid, pelargonic acid, tall fatty acid, palm fatty acid, coconut fatty acid, and beef tallow fatty acid may be exemplified.

In a case where PE4E is produced, it is technically difficult to produce only PE4E, and there is a case where PE1E, PE2E, and PE3E are mixed with PE4E. For that reason, even a commercially available product as "pentaerythritol tetraester" is not composed of only PE4E, and mainly includes PE4E but also includes PE3E, PE2E, PE1E, or the like in addition to PE4E. For that reason, the "pentaerythritol tetraester" according to the present invention may be a mixture of pentaerythritol ester that is commercially available as "pentaerythritol tetraester" or may be a mixture of pentaerythritol ester including 80% or more of "pentaerythritol tetraester".

For the same reason, the "pentaerythritol diester" according to the present invention may be a mixture of pentaerythritol ester that is commercially available as "pentaerythritol diester" or may be a mixture of pentaerythritol ester including 80% or more of "pentaerythritol diester". The same applies to PE1E and PE3E.

(Friction Characteristics of Shock Absorber-Lubricating Oil According to the Present Invention)

Next, the friction characteristics of the shock absorber-lubricating oil according to the present invention will be described. In the present invention, the friction characteristics of the shock absorber-lubricating oil were analyzed by using a friction test device 10 having the configuration illustrated in FIG. 1. As illustrated in FIG. 1, the friction test device 10 is a pin-on-disk type friction test device and a disk test piece 2 fixed on a slide bearing 1 is reciprocated by an electromagnetic vibrator 3, and a frictional force generated by pressing and sliding a pin test piece 4 against the disk test piece 2 is measured by using a strain gauge 6 attached to a fixed shaft 5 of the pin test piece 4. In addition, since a combination of the shock absorber-lubricating oil and an oil seal is a factor that affects the friction characteristics of the shock absorber, in the friction test device 10 illustrated in FIG. 1, acrylonitrile-butadiene rubber (NBR) used as the oil seal in the shock absorber was used for the pin test piece 4, such that the tip of the pin test piece 4 was cut at an angle of 140° in imitation of the shape of an oil lip. In addition, a hard chromium plating film used on the surface of a piston rod was used for the disk test piece 2. In the example illustrated in FIG. 1, the frictional force (friction coefficient) between the pin test piece 4 of the NBR and the chromium-plated disk test piece 2 was measured, but the frictional force (friction coefficient) between a copper ball and the chromium-plated disk test piece 2 may be measured.

FIG. 2 is a view illustrating an example of results obtained by measuring the frictional force of the shock absorber-lubricating oil by reciprocating the pin test piece 4 and the disk test piece 2 at an amplitude of ±2.0 mm, a frequency of 1.5 Hz, a load of 20 N, and a temperature of 30° C., using the above friction test device 10. FIG. 2 illustrates that the operation directions of the pin test piece 4 and the disk test piece 2 are reversed in the phase of $\pi/2$ and $3\pi/2$. In the example illustrated in FIG. 2, since the operation directions of the pin test piece 4 and the disk test piece 2 are reversed, a stationary state is temporarily brought about at the timings of $\pi/2$ and $3\pi/2$, and immediately after that, the stationary state transits to a slip state. As illustrated in FIG. 2, the shock absorber-lubricating oil according to the present embodiment has a frictional force peak, as the friction characteristics, when the slip state transits to the stationary state or the stationary state transits to the slip state. In this way, by using the friction test device 10, a peak value $F_{sa}$ of the frictional force when the slip state transits to the stationary state or when the stationary state transits to the slip state, and an average frictional force ($F_{ave}$) in the slip state during the minute vibration can be measured.

FIG. 3 is a view illustrating the friction characteristics of the shock absorber-lubricating oil measured as illustrated in FIG. 2 in circulating figures. Specifically, (A) illustrates a circulating figure of the friction characteristics of a shock absorber-lubricating oil (Comparative Example 1) using a GIII mineral oil as the base oil and not containing pentaerythritol ester and ZnDTP. (B) illustrates a circulating figure of the friction characteristics of a shock absorber-lubricating oil (Comparative Example 2) in which the GIII mineral oil is used as the base oil and pentaerythritol tetraester, having an enanthic acid residue, and ZnDTP are added as the friction modifier. (C) illustrates a circulating figure of the friction characteristics of a shock absorber-lubricating oil (Example) in which ester oil of isodecyl alcohol and pelargonic acid is used as the base oil and pentaerythritol tetraester, having the enanthic acid residue, and ZnDTP are added as the friction modifier.

Here, first, the circulating figures illustrated in FIG. 3 will be described with reference to FIG. 4. FIG. 4 is a view to explain a circulating figure of the friction characteristics of the shock absorber-lubricating oil. In FIG. 4, P1 represents a frictional force (for example, a frictional force having a phase of $3\pi/4$ to $\pi$ of FIG. 2) of the shock absorber-lubricating oil in a slip state in which the pin test piece 4 is slid in a forward direction while being accelerated, and P2 represents a frictional force (for example, a frictional force in the phase of $\pi$ to $5\pi/4$ of FIG. 2) of the shock absorber-lubricating oil in a slip state in which the pin test piece 4 is slid in the forward direction while being decelerated. Similarly, P3 represents a frictional force (for example, a frictional force having a phase of $7\pi/4$ to $2\pi$ of FIG. 2) of the shock absorber-lubricating oil in a slip state in which the pin test piece 4 is slid in a return direction while being accelerated, and P4 represents a frictional force (for example, a frictional force in the phase of $2\pi$ to $\pi/4$ of FIG. 2) of the shock absorber-lubricating oil in a slip state in which the pin test piece 4 is slid in the return direction while being accelerated. In addition, P5 represents a frictional force of the shock absorber-lubricating oil when the shock absorber is slid in the forward direction and immediately before stopped, P6 represents a frictional force of the shock absorber-lubricating oil immediately after the shock absorber is slid in the return direction, P7 represents a frictional force of the shock absorber-lubricating oil when the shock absorber is slid in the return direction and immediately before stopped, and P8 represents a frictional force of the shock absorber-lubricating oil immediately after the shock absorber is slid in the forward direction.

In FIG. 3, the amplitude of the shock absorber is set to a minute amplitude of ±2.0 mm, representing the friction characteristics of the vibration generated on a road or the like in the relatively good road condition. In the shock absorber-lubricating oil of Comparative Example 1 illustrated in (A), which does not contain the pentaerythritol ester, it can be seen that, compared to the shock absorber-lubricating oil of Comparative Example 2 illustrated in (B), which contains the pentaerythritol ester, or the shock absorber-lubricating oil of Example illustrated in (C), the frictional force immediately before the shock absorber is stopped or immediately after the shock absorber is slid is kept lower. Since the shock absorber-lubricating oil of Comparative Example 1 illustrated in (A) does not contain the pentaerythritol ester, it can be seen from this that, compared to the shock absorber-lubricating oil of Comparative Example 2 illustrated in (B) or the shock absorber-lubricating oil of Example illustrated in (C), particularly the frictional force does not act strongly on the vibration at a minute amplitude of the shock absorber and the operability (traction, tire ground contact properties, acceleration performance, braking performance, behavior performance such as the rolling and pitching of a vehicle body, and the like) on a road in which the road condition is relatively good tends to be lowered.

Meanwhile, in the shock absorber-lubricating oil of Comparative Example 2 illustrated in (B), which contains the pentaerythritol ester and has the GIII mineral oil as the base oil, the frictional force immediately before the shock absorber is stopped or immediately after the shock absorber is slid becomes high. As a result, compared to the shock absorber-lubricating oil of Comparative Example 1 illustrated in (A), which does not contain the pentaerythritol ester, the frictional force acts strongly on the vibration of the shock absorber at a minute amplitude, and the operability of the shock absorber at a minute amplitude is good. However, in the shock absorber-lubricating oil illustrated in (B), which contains the pentaerythritol ester as the base oil and has the GIII mineral oil as the base oil, it can be seen that, compared to the shock absorber-lubricating oil of Example illustrated in (C), which similarly contains the pentaerythritol ester and has the ester oil as the base oil, the frictional force and the friction coefficient in the slip state are high, and the ride comfort at a minute amplitude is lowered.

In contrast, in the shock absorber-lubricating oil of Example illustrated in (C), which has the ester oil as the base oil, the frictional force immediately before the shock absorber is stopped or immediately after the shock absorber is slid is also high. Therefore, similar to the shock absorber-lubricating oil of Comparative Example 2 illustrated in (B), which contains the pentaerythritol ester, the frictional force acts strongly on the vibration of the shock absorber at a minute amplitude, and the operability of the shock absorber at a minute amplitude is good. Moreover, in the shock absorber-lubricating oil of Example illustrated in (C), which contains the pentaerythritol ester and has the ester oil as the base oil, it can be seen that, compared to the shock absorber-lubricating oil of Comparative Example 2 illustrated in (B), which similarly contains the pentaerythritol ester and has the GIII mineral oil as the base oil, it is also possible to suppress the frictional force in the slip state low, and the ride comfort at a minute amplitude is also good. In this way, in the shock absorber-lubricating oil of Example illustrated in (C), which has the ester oil as the base oil, compared to the shock absorber-lubricating oil of Comparative Example 2 illustrated in (B), which has the GIII mineral oil as the base oil, it is possible to make both the operability and the ride comfort at a minute amplitude compatible with each other.

In this way, the shock absorber-lubricating oil according to the present invention contains the pentaerythritol ester as the friction modifier and has the ester oil as the main component, as the base oil, thereby making it possible to secure the operability at a minute amplitude while enhancing the ride comfort at a minute amplitude. In the present invention, the friction characteristics based on the frictional force of the shock absorber-lubricating oil immediately before the shock absorber is stopped or the frictional force of the shock absorber-lubricating oil immediately after the shock absorber is slid, which serve as indexes of the operability (traction, tire ground contact properties, acceleration performance, braking performance, behavior performance such as the rolling and pitching of a vehicle body, and the like) at a minute amplitude of the shock absorber, is defined as a responsiveness RI. Specifically, as shown in the following Equation (1), the ratio of a difference between a peak value $F_{sa}$ of the frictional force of the shock absorber-lubricating oil immediately before the shock absorber is stopped or the frictional force of the shock absorber-lubricating oil immediately after the shock absorber is slid, that is, the frictional force of the shock absorber-lubricating oil when the stationary state transits to the slip state or when the slip state transits to the stationary state, and an average value $F_{ave}$ of the frictional force of the shock absorber-lubricating oil in the slip state, to the average frictional force $F_{ave}$ in the slip state is defined as the responsiveness RI.

$$\text{Responsiveness } RI = (F_{sa} - F_{ave})/F_{ave} \quad (1)$$

In the present example, the average friction coefficient and the responsiveness RI of the various shock absorber-lubricating oils were measured using the friction test device 10 illustrated in FIG. 1, and the results are plotted in FIG. 5. In the example illustrated in FIG. 5, the pin test piece 4 and the disk test piece 2 were reciprocated at an amplitude of ±2.5 mm/sec, a speed of 4.0 mm/sec, a load of 20 N, and a temperature of 30°° C. to measure the average friction coefficient and the responsiveness RI of the various shock absorber-lubricating oils. In addition, the shock absorber-lubricating oils shown below contain ZnDTP and an FM agent as the friction modifier, unless otherwise specified.

White square □ illustrated in FIG. 5 is given by plotting the measurement results of the average friction coefficient μ and the responsiveness RI of a shock absorber-lubricating oil of which the base oil is a mineral oil (a mineral oil other than the GIII mineral oil) and to which a general friction modifier (however, the ZnDTP, the FM agent, and the pentaerythritol ester are not included) is added. In addition, diamond shape ◇ illustrated in FIG. 5 is given by plotting the measurement results of the average friction coefficient μ and the responsiveness RI of a shock absorber-lubricating oil of which the base oil is the GIII mineral oil and to which a general friction modifier (however, the ZnDTP, the FM agent, and the pentaerythritol ester are not included) is added. In addition, in FIG. 5, an area with a large number of the shock absorber-lubricating oils indicated by white square □ and diamond shape ◇ is indicated by a circle C. In the shock absorber-lubricating oils obtained by simply adding the general friction modifier to the mineral oil that is the base oil, the lubricating oils are scattered in the area indicated by the circle C in FIG. 5, the responsiveness RI does not exceed 0.4, and it is not possible to enhance the responsiveness RI.

In addition, black circle ● illustrated in FIG. 5 is given by plotting the measurement results of the average friction coefficient μ and the responsiveness RI of a shock absorber-lubricating oil in which a plurality of different types of pentaerythritol esters is added to a naphthene-based base oil. Specifically, N1 is a shock absorber-lubricating oil obtained by adding PE2E having the oleic acid residue in 2% by weight of the total amount to the naphthene-based base oil, N2 is a shock absorber-lubricating oil obtained by adding PE3E having the oleic acid residue in 30% by weight of the total amount to the naphthene-based base oil, and N3 is a shock absorber-lubricating oil obtained by adding PE4E having the oleic acid residue in 25% by weight of the total amount and PE3E having the enanthic acid residue in 5% by weight of the total amount to the naphthene-based base oil. In addition, N4 is a shock absorber-lubricating oil obtained by adding PE4E having the oleic acid residue in 30% by weight of the total amount to the naphthene-based base oil, and N5 is a shock absorber-lubricating oil obtained by adding PE4E having the oleic acid residue in 29% by weight of the total amount and PE3E having the enanthic acid residue in 1% by weight of the total amount to the naphthene-based base oil. In addition, in FIG. 5, an approximation curve of the shock absorber-lubricating oils N1 to N5 of the naphthene-based base oil is indicated as LN.

As illustrated in FIG. 5, in the shock absorber lubricating oils N1 to N5 of the naphthene-based base oil, it can be seen that the larger the number of ester groups of the pentaerythritol ester, the higher the average friction coefficient μ and the responsiveness RI tend to be. In addition, in the approximation curve LN of the shock absorber lubricating oils N1 to N5 of the naphthene-based base oil, it can be seen that, compared to an approximation curve LP of the shock absorber lubricating oils P1 and P2 having PAO to be described below as the base oil, an approximation curve LG of shock absorber lubricating oils G1 to G4 having the GIII mineral oil as the base oil and containing the pentaerythritol ester and an approximation curve LE of shock absorber lubricating oils EA1 to EA2, EB1 to EB9, and EC1 to EC6 having the ester oil as the base oil, in the approximation curve LN, the inclination of the approximation curve is small, and the larger the responsiveness RI, the higher the degree of increase in the average friction coefficient μ becomes. It can be seen from this that, in a case where the naphthene-based base oil is used as the base oil, there is a concern that the ride comfort is lowered in a case where the operability at a minute amplitude is enhanced by the pentaerythritol ester.

In addition, white circle o illustrated in FIG. 5 is given by plotting the measurement results of the average friction coefficient μ and responsiveness RI of a shock absorber-lubricating oil of which the base oil is poly-α-olefin (PAO2C) and to which the friction modifier containing the pentaerythritol ester is added. Specifically, P1 is a shock absorber-lubricating oil obtained by adding PE3E having the oleic acid residue in 10% by weight of the total amount to the base oil of PAO2C, and P2 is a shock absorber-lubricating oil obtained by adding PE4E having the oleic acid residue in 30% by weight of the total amount to the base oil of PAO2C. In addition, in FIG. 5, an approximation curve of the shock absorber-lubricating oils P1 and P2 having PAO2C as the base oils is indicated as LP.

It can also be seen that, even in the shock absorber-lubricating oil having PAO2C as the base oil, the larger the number of ester groups of the pentaerythritol ester, the higher the average friction coefficient μ and the responsiveness RI tend to be. In addition, it can be seen that, although the approximation curve LP of the shock absorber-lubricating oils P1 and P2 having PAO2C as the base oil has a larger inclination than the approximation curve LN of the shock absorber-lubricating oils N1 to N5 having the naphthene-based base oil, compared to the approximation curve LG of the shock absorber-lubricating oils G1 to G4 having the GIII mineral oil as the base oil and containing the pentaerythritol ester and the approximation curve LE of the shock absorber-lubricating oils EA1 to EA2, EB1 to EB9, and EC1 to EC6 having the ester as the base oil, in the approximation curve LP, the inclination of the approximation curve is small, and the larger the responsiveness RI, the higher the degree of increase in the average friction coefficient μ becomes. It can be seen from this that, in a case where PAO2C is used as the base oil and in a case where the operability at a minute amplitude is enhanced by the pentaerythritol ester, there is a concern that the ride comfort is lowered, compared to a case where the GIII mineral oil or the ester oil is used as the base oil.

In addition, black triangle ▲ illustrated in FIG. 5 is given by plotting the measurement results of the average friction coefficient μ and responsiveness RI of a shock absorber-lubricating oil of which the GIII mineral oil is used as the base oil and to which the friction modifier containing the pentaerythritol ester is added. Specifically, G1 is a shock absorber-lubricating oil obtained by adding PE2E having the oleic acid residue in 2% by weight of the total amount to the base oil of the GIII mineral oil, G2 is a shock absorber-lubricating oil obtained by adding PE4E having the oleic acid residue in 30% by weight of the total amount to the base oil of the GIII mineral oil, G3 is a shock absorber-lubricating oil obtained by adding PE4E having the oleic acid residue in 26% by weight of the total amount to the base oil of the GIII mineral oil, and G4 is a shock absorber-lubricating oil obtained by adding PE4E having the enanthic acid residue in 20% by weight of the total amount to the base oil of the GIII mineral oil. In addition, in FIG. 5, an approximation curve of the shock absorber-lubricating oil G1 to G4 having the GIII mineral oil as the base oil and containing the pentaerythritol ester is indicated as LG.

It can also be seen that, even in the shock absorber-lubricating oils having the GIII mineral oil as the base oil and containing the pentaerythritol ester, the larger the number of ester groups of the pentaerythritol ester, the higher the average friction coefficient μ and the responsiveness RI tend to be. In addition, it can be seen that, although the approximation curve LG of the shock absorber-lubricating oils G1 to G4 having the GIII mineral oil as the base oil and containing the pentaerythritol ester has a larger inclination than the approximation curve LN of the shock absorber-lubricating oils N1 to N5 having the naphthene-based base oil and the approximation curve LP of the shock absorber-lubricating oils P1 and P2 having PAO2C as the base oil, compared to the approximation curve LE of the shock absorber-lubricating oils EA1 to EA2, EB1 to EB9, and EC1 to EC6 having the ester oil as the base oil, in the approximation curve LG, the inclination of the approximation curve is small, and the larger the responsiveness RI, the higher the degree of increase in the average friction coefficient μ becomes. It can be seen from this that, in a case where the GIII mineral oil is used as the base oil and in a case where the operability at a minute amplitude is enhanced by the pentaerythritol ester, there is a concern that the ride comfort is lowered, compared to a case where the ester oil is used as the base oil.

In addition, in FIG. 5, EA1 to EA2 indicated by hatched circle ○, EB1 to EB9 indicated by diamond shape ◇ filled in black, and EC1 to EC6 indicated by square □ filled in gray are given by plotting the measurement results of the average friction coefficient μ and the responsiveness RI of the shock absorber-lubricating oils each having the ester oil as the base oil. Specifically, EA1 to EA2, EB1 to EB9, and EC1 to EC6 are shock absorber-lubricating oils having the compositions shown in Table 1 below.

TABLE 1

| | Base oil | | | Pentaerythritol ester | | |
|---|---|---|---|---|---|---|
| Sample | Alcohol | Fatty acid | Type | Type | Fatty acid residue | Content (%) |
| EA1 | 2-ethylhexanol | Oleic acid | Monoester | PE4E | Enanthic acid residue | 30 |
| EA2 | | | | | Oleic acid residue | 30 |
| EB1 | Isooctyl alcohol | Adipic acid | Monoester | PE2E | Oleic acid residue | 2 |
| EB2 | | | | PE3E | | 30 |
| EB3 | | | | | | 17.5 |
| EB4 | | | | PE4E | | 30 |
| EB5 | | | | | | 20 |
| EB6 | | | | PE3E | Enanthic acid residue | 30 |
| | | | | PE4E | Oleic acid residue | |
| EB7 | | | | PE4E | Oleic acid residue | 30 |
| EB8 | | | | | | 17.5 |

TABLE 1-continued

| | Base oil | | | Pentaerythritol ester | | |
|---|---|---|---|---|---|---|
| Sample | Alcohol | Fatty acid | Type | Type | Fatty acid residue | Content (%) |
| EB9 | | | | | | 10 |
| EC1 | Isodecyl alcohol | Pelargonic acid | Monoester | PE3E | Oleic acid residue | 30 |
| EC2 | | | | PE2E | | 2 |
| EC3 | | | | PE4E | | 30 |
| EC4 | | | | PE3E | Enanthic acid residue | 30 |
| EC5 | | | | PE4E | Oleic acid residue | |
| EC6 | | | | PE4E | Enanthic acid residue | 20 |

That is, EA1 is a shock absorber-lubricating oil in which 2-ethylhexanol and oleic acid monoester are used as the base oil and to which 30% by weight of PE4E having the enanthic acid residue is added, and EA2 is a shock absorber-lubricating oil in which 2-ethylhexanol and oleic acid monoester are used as the base oil and to which 30% by weight of PE4E having the oleic acid residue is added. In addition, EB1 to EB9 are shock absorber-lubricating oils having a monoester of isooctyl alcohol and adipic acid as the base oil commonly, EB1 contains PE2E having the oleic acid residue in 2% by weight of the total amount, EB2 contains PE3E having the oleic acid residue in 30% by weight of the total amount, EB3 contains PE3E having the oleic acid residue in 17.5% by weight of the total amount, EB4 contains PE4E having the oleic acid residue in 30% by weight of the total amount, EB5 contains PE4E having the oleic acid residue in 20% by weight of the total amount, EB6 contains PE4E having the oleic acid residue in 5% by weight of the total amount and PE4E having the enanthic acid residue in 25% by weight of the total amount, EB7 contains PE4E having the oleic acid residue in 30% by weight of the total amount, EB8 contains PE4E having the oleic acid residue in 17.5% by weight of the total amount, and EB9 contains PE4E having the oleic acid residue in 10% by weight of the total amount. Although EB4 and EB7 have the same composition, the measurement results are different because the number of samples and the measurement date are different. Moreover, EC1 to EC6 are shock absorber-lubricating oils having the monoester of isodecyl alcohol and pelargonic acid as the base oil commonly, EC1 contains PE3E having the oleic acid residue in 30% by weight of the total amount, EC2 contains PE2E having the oleic acid residue in 2% by weight of the total amount, EC3 contains PE4E having the oleic acid residue in 30% by weight of the total amount, EC4 contains PE4E having the oleic acid residue in 15% by weight of the total amount and PE3E having the enanthic acid residue in 15% by weight of the total amount, EC5 contains PE4E having the oleic acid residue in 10% by weight of the total amount and PE3E having the enanthic acid residue in 20% by weight of the total amount, and EC6 contains PE4E having the enanthic acid residue in 20% by weight of the total amount. In addition, in FIG. 5, the approximation curve of the shock absorber-lubricating oils EA1 to EA2, EB1 to EB9, and EC1 to EC6, having the ester oil as the base oil, is indicated as LE.

It can also be seen that, even in the shock absorber-lubricating oils using the ester oil as the base oil, the larger the number of ester groups of the pentaerythritol ester, the higher the average friction coefficient μ and the responsiveness RI tend to be. In addition, in the approximation curve LE of the shock absorber-lubricating oils EA1 to EA2, EB1 to EB9, and EC1 to EC6 having the ester oil as the base oil, it can be seen that, compared to the approximation curve LN of the shock absorber-lubricating oils N1 to N5 having the naphthene-based base oil, the approximation curve LP of the shock absorber-lubricating oils P1 and P2 having PAO2C as the base oil, and the approximation curve LG having the GIII mineral oil as the base oil and containing the pentaerythritol ester, the inclination of the approximation curve is larger (more vertical), and the increase in the average friction coefficient μ is smaller even if the responsiveness RI becomes larger. It can be seen from this that, in a case where the ester oil is used as the base oil, the ride comfort can be enhanced compared to other base oils even if the operability at a minute amplitude is improved by the pentaerythritol ester.

In addition, compared to EA1 to EA2 having the monoester of 2-ethylhexanol and oleic acid as the base oil, in EB1 to EB9 having the monoester of isodecyl alcohol and pelargonic acid as the base oil, and EC1 to EC6 having the monoester of isodecyl alcohol and pelargonic acid as the base oil, the increase in the average friction coefficient μ tends to be small even if the responsiveness RI becomes large. In particular, in the shock absorber-lubricating oil EC6 having the monoester of isodecyl alcohol and pelargonic acid as the base oil and containing PE4E having the oleic acid residue and the enanthic acid residue in 30% by weight of the total amount, the average friction coefficient is less than 0.06 while the responsiveness RI exceeded 0.8. As a result, the operability and the ride comfort are significantly improved compared to the related art.

Moreover, in a case where PE4E is used as the pentaerythritol ester in the shock absorber-lubricating oil having the ester oil as the base oil, it can be seen that, compared to a case where PE4E has only a long-chain fatty acid residue such as the oleic acid residue, the responsiveness RI tends to be higher in a case where PE4E has a medium-chain fatty acid residue such as the enanthic acid residue.

As described above, the shock absorber-lubricating oil composition according to the present invention is characterized by containing, as a main component, the pentaerythritol ester as the friction modifier and containing the ester oil as the base oil. In this way, by using the ester oil as the base oil, as illustrated in FIG. 5, it is possible to provide the shock absorber-lubricating oil composition capable of enhancing the responsiveness RI while the average friction coefficient μ is suppressed low and capable of compatibly improving both the operability and the ride comfort. In particular, in a case where the ester oil is used as the base oil, even if the type of pentaerythritol ester to be added is changed, it is possible to enhance the responsiveness RI while suppressing the friction coefficient low. Therefore, it is possible to change the type of pentaerythritol ester to be added to adjust the shock absorber-lubricating oil to have a desired responsiveness RI.

In addition, in the shock absorber-lubricating oil according to the present invention, it is possible to further enhance the responsiveness RI of the shock absorber-lubricating oil by adding PE4E as the pentaerythritol ester, and it is possible to further enhance the responsiveness RI of the shock absorber-lubricating oil by using the pentaerythritol ester having the medium-chain fatty acid residue rather than the long-chain fatty acid residue as the fatty acid residue of the pentaerythritol ester. In this way, by adjusting the responsiveness RI of the shock absorber-lubricating oil to be higher, it is possible to further improve behavior performance such as a tire grip force (ground contact performance), acceleration performance, braking performance, and rolling and pitching of a vehicle body, and it is possible to improve controllability and stability.

As described above, although the preferred embodiment of the present invention has been described, the technical scope of the present invention is not limited to the descriptions of the above embodiment. It is possible to make various changes and improvements to the above-described embodiment, and embodiments in which such changes and improvements have been made are also included in the technical scope of the present invention.

The invention claimed is:

1. A shock absorber-lubricating oil composition comprising:

a base oil; and a friction modifier, wherein the friction modifier contains a pentaerythritol ester, the base oil contains an ester oil as a main component, the ester oil is an ester oil combining a fatty acid with less than 18 carbon atoms and an alcohol, the pentaerythritol ester is contained at a ratio of 2% to 30% by weight of the whole shock absorber-lubricating oil composition, the ester oil is a monoester oil, and the pentaerythritol ester contains a pentaerythritol tetraester as a main component.

2. The shock absorber-lubricating oil composition according to claim 1, wherein the base oil contains the ester oil in 50% by weight or more of the whole base oil, or a proportion of the ester oil in the base oil is largest.

3. The shock absorber-lubricating oil composition according to claim 1, wherein the base oil contains 90% by weight or more of the ester oil in the base oil.

4. The shock absorber-lubricating oil composition according to claim 1, wherein the pentaerythritol ester is a pentaerythritol ester having a fatty acid with 6-12 carbon atoms.

5. The shock absorber-lubricating oil composition according to claim 1, wherein the base oil has a viscosity index of 60 or less.

6. The shock absorber-lubricating oil composition according to claim 1, wherein the friction modifier further contains zinc dithiophosphate.

7. A shock absorber comprising:

the shock absorber-lubricating oil composition according to claim 1.

8. A method for adjusting friction characteristics of a shock absorber-lubricating oil composition, the method comprising:

adding a friction modifier containing a pentaerythritol ester to a base oil containing an ester oil as a main component, wherein the ester oil is an ester oil combining a fatty acid with less than 18 carbon atoms and an alcohol, the pentaerythritol ester is contained at a ratio of 2% to 30% by weight of the whole shock absorber-lubricating oil composition, the ester oil is a monoester oil, and the pentaerythritol ester contains a pentaerythritol tetraester as a main component.

9. The shock absorber-lubricating oil composition according to claim 1, wherein the base oil has a kinematic viscosity of 10 $mm^2/s$ or less at 40° C.

10. The shock absorber-lubricating oil composition according to claim 1, wherein the ester oil is the monoester oil combining the fatty acid with less than 18 carbon atoms and a higher alcohol.

11. The shock absorber-lubricating oil composition according to claim 10, wherein the fatty acid is selected from the group consisting of oleic acid and enanthic acid, or the higher alcohol is selected from the group consisting of 2-ethylhexanol, isooctyl alcohol and isodecyl alcohol.

12. The shock absorber-lubricating oil composition according to claim 1, wherein the pentaerythritol tetraester contains an enanthic acid residue or oleic acid residue.

13. The shock absorber-lubricating oil composition according to claim 8, wherein the ester oil is the monoester oil combining the fatty acid with less than 18 carbon atoms and a higher alcohol.

14. The shock absorber-lubricating oil composition according to claim 13, wherein the fatty acid is selected from the group consisting of oleic acid and enanthic acid, or the higher alcohol is selected from the group consisting of 2-ethylhexanol, isooctyl alcohol and isodecyl alcohol.

15. The shock absorber-lubricating oil composition according to claim 8, wherein the pentaerythritol tetraester contains an enanthic acid residue or oleic acid residue.

* * * * *